US011333309B1

(12) United States Patent
Martini

(10) Patent No.: US 11,333,309 B1
(45) Date of Patent: May 17, 2022

(54) MAGNETIC DECORATIVE LIGHTING

(71) Applicant: Nu Tsai Capital, Omaha, NE (US)

(72) Inventor: Richard Martini, Glenview, IL (US)

(73) Assignee: NU TSAI CAPITAL, Omaha, NE (US)

( * ) Notice: Subject to any disclaimer, the term of this patent is extended or adjusted under 35 U.S.C. 154(b) by 0 days.

(21) Appl. No.: 17/217,321

(22) Filed: Mar. 30, 2021

(51) Int. Cl.
*F21S 4/10* (2016.01)
*F21Y 107/50* (2016.01)
*F21W 121/00* (2006.01)

(52) U.S. Cl.
CPC ..... *F21S 4/10* (2016.01); *F21W 2121/00* (2013.01); *F21Y 2107/50* (2016.08)

(58) Field of Classification Search
CPC ..... F21S 4/10; F21Y 2107/50; F21V 21/08; F21V 21/096
See application file for complete search history.

(56) References Cited

U.S. PATENT DOCUMENTS 5,722,853 A * 3/1998 Hwang ..... F21V 21/002 439/340
6,010,346 A * 1/2000 Wang ..... F21V 21/002 439/340
6,062,705 A * 5/2000 Zimmer ..... H01R 33/965 362/640
6,380,683 B1 * 4/2002 Kahn ..... H01J 5/50 315/56
7,549,779 B2 6/2009 Genenbacher
8,651,711 B2 * 2/2014 Rudisill ..... F21V 29/507 362/398
10,236,627 B1 * 3/2019 Krize ..... H01R 13/24
11,060,706 B1 * 7/2021 Rivera ..... F21V 23/06
2010/0290240 A1 * 11/2010 Genenbacher ..... F21V 21/096 362/398
2011/0038159 A1 * 2/2011 Carlson ..... F21V 21/096 362/249.16
2012/0069587 A1 * 3/2012 Holland ..... F21V 21/088 362/396
2013/0044501 A1 * 2/2013 Rudisill ..... F21V 21/35 362/398
2015/0311657 A1 * 10/2015 Glover ..... F21S 4/10 439/502
2020/0032989 A1 * 1/2020 Genenbacher ..... F21S 4/10

FOREIGN PATENT DOCUMENTS

EP 1486724 A1 * 12/2004 ..... F21V 21/0824

* cited by examiner

*Primary Examiner* — Leah Simone Macchiarolo
(74) *Attorney, Agent, or Firm* — Dunlap Bennett & Ludwig, PLLC

(57) ABSTRACT

A stringed holiday lighting ornament contains both drain holes at its base to alleviate moisture build-up, and protruding magnets for secure attachment to ferromagnetic surfaces, whereby such protrusion permits the drain holes to be exposed to the air and thus flow and/or evaporate away accumulated moisture.

7 Claims, 4 Drawing Sheets

MAGNETIC DECORATIVE LIGHTING

FIELD OF THE INVENTION

The present invention relates to decorative lighting, particularly holiday lighting that comes in strings.

BACKGROUND OF THE INVENTION

Decorative lighting often comes in strings. A typical arrangement is a string of sockets into which bulbs (such as C7 or C9) are placed. In the usual case, strings are hung by staples or by separate clip devices.

In the field, it has been observed that water pools in the socket, even when a bulb is attached. This creates corrosion and short circuit risk. As a result, to mitigate this problem, drain holes have been used in the socket bases of stringed decorative lighting.

Meanwhile, magnetic decorative lighting has been developed which provides certain advantages in certain hanging contexts. Magnetic decorative lighting can bring significant advantages in terms of ease of installation and removal. The typical residential site has aluminum gutters at the roofline where lighting typically goes, so magnetic lighting is of little use there. Commercial establishments, however, also hang decorative stringed lighting. It is commonplace for a commercial structure to have a metallic covering, band, flashing or other structure on a wall, roof or roofline that is ferromagnetic and can therefore receive magnetically secured lights. One example of such lights is described in U.S. Pat. No. 7,549,779.

Important to the '779 patent is that, in a socket, there should be a single magnet embedded in the base that is flush with the end of the base—does not "protrude" in the words of that patent. That design therefore focuses on in situ appearance, without recognition of moisture in the socket that would accumulate in the field. The design of the '779 patent omits drain holes. FIGS. 2 and 9A of that patent disclose a structure (plastic coating 2) that aggravates this moisture issue by completely covering the end of the base. Even if drain holes existed in a design conforming otherwise to the '779 patent, those holes would be blocked in normal use where the base is completely flush with the ferromagnetic material to which it is attached.

An object of the present invention is to deliver the installation-and-removal advantages of magnetic decorative lighting without those disadvantages and problematic features that exist in the prior art.

SUMMARY OF THE INVENTION

The present invention provides for at least one, and preferably two, magnets that protrude from the end of a decorative lighting base, in combination with drain holes. With two such magnets, their combined strength possesses enough force for securement, while a channel between them provides a drainage path for moisture (whether flow or evaporation) when such lighting is installed outdoors for extended periods.

DETAILED DESCRIPTION

Figure 1:
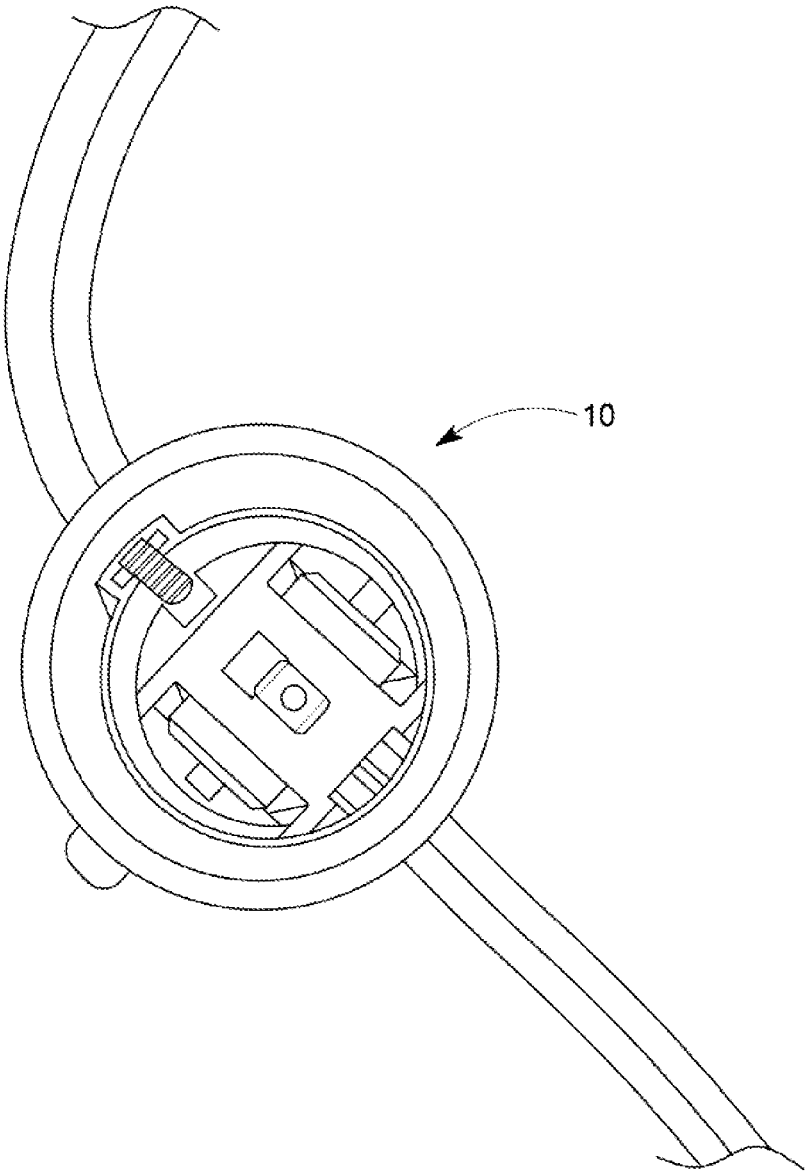
FIG. 1 is a plan view from above looking into the socket of decorative lighting according to the invention.

The moisture-mitigating design of the preferred embodiment is shown in FIGS. 1 to 4. FIG. 1 shows a plan view of an embodiment of the invention looking into the socket 10. Electrical connections exist in the socket 10 for receiving a bulb. While the present design is useful for C7 and C9 sized bulbs, the invention can be adapted to accommodate any sized bulb usable within stringed decorative lighting.

Figure 2:
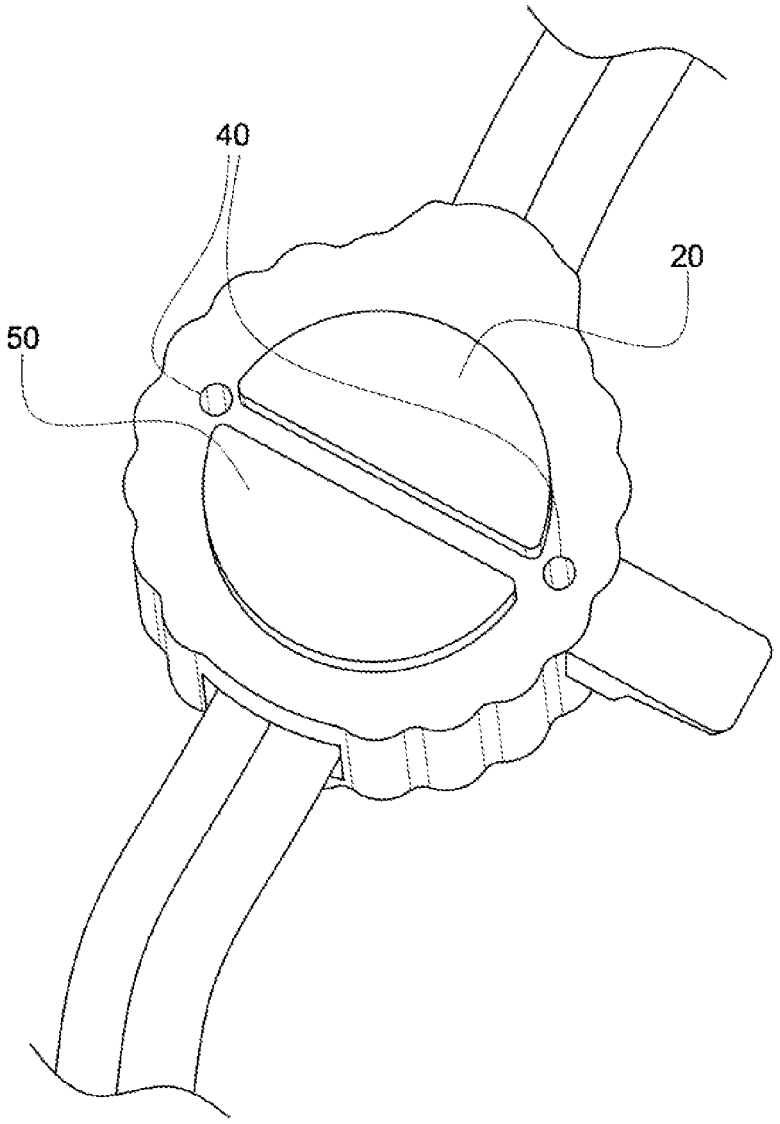
FIG. 2 is a plan view from below looking to the base of the socket of decorative lighting according to the invention.

FIG. 2 depicts a plan view from below looking to the base of socket 10. Two magnets 20 and 50 protrude from the base of socket 10. The magnets themselves may be constructed from product designation N40 or N45, available from Dongguan Yutong Magnet Co., Ltd. In this embodiment, the magnets take on the appearance of opposing semicircles of approximately 12 mm diameter and 4 mm thickness. There is a linear separation between them of about 1 mm. At either end of the separation, there exist drain holes 40 for the socket 10. These drain holes communicate all the way into the interior of socket 10 to allow moisture to either flow or evaporate out. Although a half circle configuration is shown, the invention is not limited to that arrangement. Although two magnets are shown, the concepts herein can be advantageously deployed using a single magnet, or three or more magnets. The semicircles may be advantageously machined from a part that was originally a full disc magnet, by slicing down the middle.

For a disc-shaped N40 magnet with 12 mm diameter and 4 mm thickness (unlike the semicircle arrangement described here), the theoretical maximum pull strength, according to the Magnetic Calculator at kjmagnetics.com, is 6.90 lbs for the case of a magnet touching a steel plate (zero distance away). (Many web-based calculators are available for determining essentially the same value, with minor deviations in calculated strengths). For a disc shaped N45 magnet, this theoretical maximum is 7.76 lbs. It is evident that each half circle magnet as configured in the invention has half of those theoretical maximum pull strengths: 3.45 lbs or 3.88 lbs, respectively. In actual use, pull strength will be affected by conditions in the field. For example layers of paint on steel would create a distance between magnet and metal, diminishing actual pull strength. In the embodiment with two magnets as described, each magnet preferably has a maximum pull strength of less than 5 lbs, and more preferably less than 4 lbs.

Figure 3:
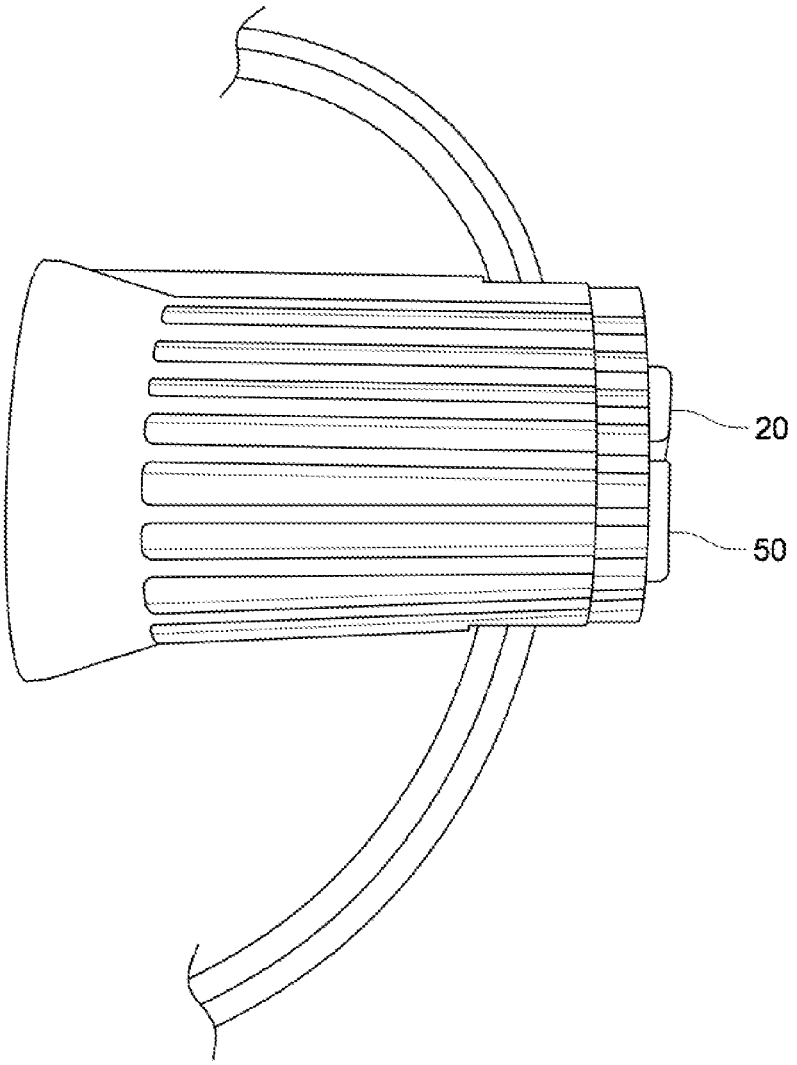
FIG. 3 is a side view of the decorative lighting according to the invention.

FIG. 3 depicts a side view of socket 10, particularly showing the protrusion of magnets 20 and 50 from the base of socket 10. This view makes it evident that, when deployed by attachment to a ferromagnetic surface, socket 10 leaves air space underneath the drain holes 40 to allow flow or evaporation to occur. This is not true of the '779 patent prior art design. Advantageously in this disclosed embodiment, the presence of a channel between magnets 20 and 50 further helps the circulation of air when socket 10 is magnetically fixed to a surface.

Figure 4:
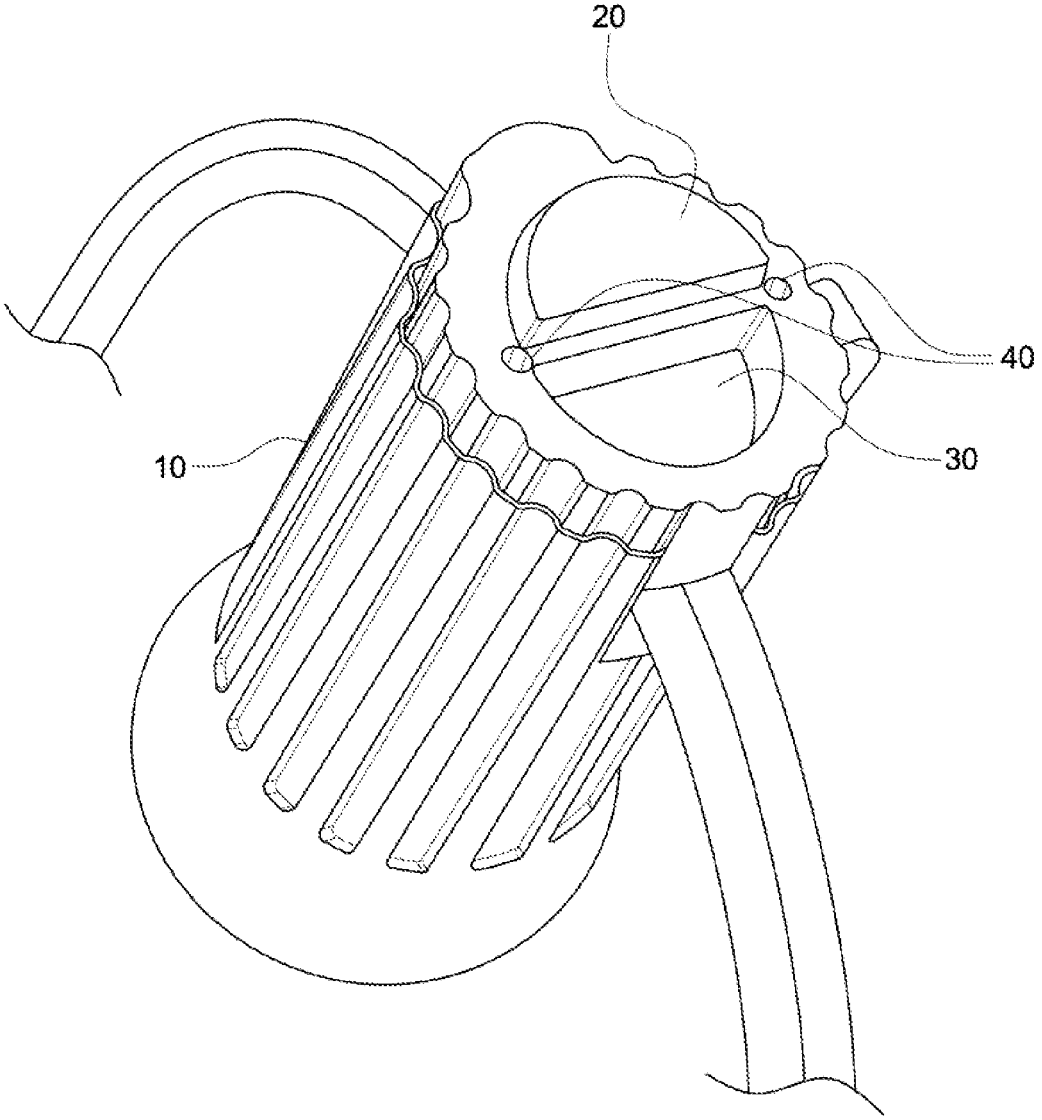
FIG. 4 is a perspective view of the base area of decorative lighting according to the invention, with one magnet removed to reveal a pocket.

FIG. 4 is a perspective view of the base area of socket 10, with one magnet removed to show the method of construction. The base is constructed (via injection molding or otherwise) to contain a pocket 30 shaped to receive magnet 50. During manufacture, magnet 50 is affixed into pocket 30 via an adhesive such as epoxy. Other methods known in the art of fixing magnet 50 into pocket 30 are also appropriate for joining those parts, such as friction fit or snap fit. Typically the base is constructed separately from the main cylindrical part of the socket 10, ready for snap-mating into the main cylindrical part. Final assembly occurs when the base is snapped into connection with the main cylindrical part, simultaneously capturing and engaging the conductors within socket 10 to realize an electrical connection with a lighting string.

To those skilled in the art to which this invention pertains, the above-described preferred embodiments may be subject to change or modification. Such change or modification can be carried out without departing from the scope of the invention, which is intended to be limited only by the scope of the appended claims.

I claim:

1. A decorative lighting system comprising:

a light bulb socket comprising a base portion the base portion comprising at least one drain hole communicating with an inside of the light bulb socket, and at least two pockets suitable for receiving a magnet;

and at least two magnets secured into the each of the at least two pockets, wherein the at least two magnets protrude from the base portion.

2. The decorative lighting system of claim 1 wherein the at least two pockets is exactly two pockets.

3. The decorative lighting system of claim 1 wherein a separation between the magnets in the at least two pockets forms a channel.

4. The decorative lighting system of claim 3 wherein the channel has two ends, and the at least one drain hole comprises two drain holes, one on each of the two ends.

5. The decorative lighting system of claim 1 wherein each different magnet is shaped as a half circle.

6. The decorative lighting system of claim 1 wherein each different magnet has a maximum pull strength of less than 5 lbs.

7. The decorative lighting system of claim 1 wherein each different magnet has a maximum pull strength of less than 4 lbs.

* * * * *